US005570962A

United States Patent [19]

Suzuki et al.

[11] Patent Number: 5,570,962

[45] Date of Patent: Nov. 5, 1996

[54] THERMAL PRINTER

[75] Inventors: Minoru Suzuki; Kiyoshi Negishi; Katsumi Kawamura; Mikio Horie; Hiroshi Orita; Katsuyoshi Suzuki, all of Tokyo, Japan

[73] Assignee: Asahi Kogaku Kogyo Kabushiki Kaisha, Tokyo, Japan

[21] Appl. No.: 433,570

[22] Filed: May 3, 1995

[30] Foreign Application Priority Data

May 18, 1994 [JP] Japan ..... 6-128330

[51] Int. Cl.[6] ..... B41J 2/32; B41J 29/02

[52] U.S. Cl. ..... 400/120.16; 400/692; 400/693; 347/108

[58] Field of Search ..... 400/88, 120.16, 400/709, 54, 596, 551, 642; 3/630, 637.1, 639, 693, 692, 691; 347/108, 109

[56] References Cited

U.S. PATENT DOCUMENTS 4,844,631 7/1989 Feron et al. ..... 400/120

5,139,351 8/1992 Kamada ..... 400/120.16

FOREIGN PATENT DOCUMENTS 2250478 6/1992 United Kingdom .

2250716 6/1992 United Kingdom .

2282568 4/1995 United Kingdom .

*Primary Examiner*—Christopher A. Bennett

*Attorney, Agent, or Firm*—Greenblum & Bernstein P.L.C.

[57] ABSTRACT

A thermal printer has with a cover member which swings away from the printer. A thermal line printhead is separated from a platen roller in response to the swinging of the cover member. A paper detector on the cover member swings away from the printer with the cover member. Accordingly, a single sensor detects when paper is loaded in the printer, when the cover is open, and when the thermal line printhead is separated from the platen roller, all of which result in the an interruption or prohibition of printing.

11 Claims, 9 Drawing Sheets

THERMAL PRINTER

BACKGROUND OF THE INVENTION

The present invention relates to thermal printer technology, and more specifically to thermal printers using a thermal line printing head (hereinafter referred to as a "printhead") to print images on thermosensitive paper.

Compact thermal printers using thermal line printheads are well known and widely used. Occasionally, a compact thermal printer is arranged to have a thermal line printhead pressed against a rotatable platen roller. Usually, the conventional thermal printer includes, among other sensors, a paper loading detector to detect if printing paper is loaded or not loaded, and a thermal line printhead release detector which detects if the thermal line printhead is pressed against the platen roller or separated from the platen roller. The paper loading detector prohibits printing operations when paper is unavailable to the printer, and the printhead release detector prohibits or interrupts printing when the thermal line printhead is separated from the platen roller.

A conventional thermal printer, including two separately mounted detectors as described, is difficult to miniaturize and has higher manufacturing costs. Fundamentally, a single controller performs the same printing interruption instruction when either sensor is activated. However more than one sensor is conventionally necessary because of the conventional arrangement of housing portions, paper insertion and discharge slots, the platen roller, and the thermal line printhead.

SUMMARY OF THE INVENTION

In a view of the aforementioned circumstances, the primary object of the present invention is to provide a miniaturized thermal printer, and reduced manufacturing costs through combining sensor functions and eliminating extraneous sensors.

The above object is met by providing an improved thermal printer, including a housing. A cover member is swingable between an open position and a closed position relative to the housing. A platen roller is rotatably supported in the printer. A thermal line printhead is contactable to the platen roller and swingable towards and away from the platen roller. A mechanism guides the thermal line printhead away from contact with the platen roller, in response to the swinging of the cover member. A paper detector, provided to the cover member is capable of detecting the presence or absence of paper in a transfer channel between the cover and the housing. The cover member exposes at least a part of the transfer channel when the cover member is opened. In this case, when the cover is open, the thermal line printhead is separated from the platen roller. The paper detector acts as a sensor for the presence of paper, for the opening of the cover, and for the separation of the thermal line printhead from the platen roller. Preferably, the paper detector is located on the cover member away from a swinging axis of the cover member, and is thereby swung away from the transfer channel and disabled from detecting paper in the transfer channel when the cover member is opened.

Preferably, the thermal printer further includes a mechanism for interrupting and prohibiting printing, responsive to the paper detector. The mechanism for interrupting and prohibiting printing interrupts and prohibits printing when the paper detector detects the absence of paper in the transfer channel. Further the mechanism for interrupting and prohibiting printing interrupts and prohibits printing when the paper detector is disabled from detecting paper in the transfer channel when the cover member is opened. In this manner, the paper detector gives a null, or "no paper", signal both when there is no paper in the transfer channel, and when the detector is moved away from the transfer channel (along with the cover member). Only a single detector is necessary both for detecting the presence of paper and detecting if the cover is open. The thermal printer also includes a mechanism for enabling printing, responsive to the paper detector. The mechanism for enabling printing enables printing when the paper detector detects the presence of paper in the transfer channel.

According to another aspect of the present invention, the cover member includes a guide portion that defines an upper boundary of the transfer channel. and the housing includes a guide wall that defines a lower boundary of the transfer channel. The transfer channel leads directly to a contact interface between a platen roller and a thermal line printhead. The paper detector is ideally provided to the guide portion of the cover member. Accordingly, the space used in the printer is minimized, and the printer can be miniaturized.

In a further feature, the paper detector includes a light emitter for emitting light towards a paper in the transfer channel and a light receiver for receiving light reflected from the paper in the transfer channel. In this case, the emitter and receiver are arranged to emit and receive light in a normal direction to and from the paper in the transfer channel when the cover member is closed. If the light emitter and light receiver are provided on the cover member away from a swinging axis of the cover member, they move away from the transfer channel and are disabled from emitting and receiving light in a normal direction to and from the paper in the transfer channel when the cover member is opened. Since the paper detector no longer faces the transfer channel or paper it is disabled when moved away. Thus, the light emitter and receiver sense both the presence of paper and movement of the cover member.

According to still another aspect of the present invention, the cover member also includes a mechanism for holding the cover member in an open position when it swings more than a predetermined amount, and for returning the cover member to a closed position when the cover member swings less than the predetermined amount. In this case, the cover is held open when the paper detector is moved away, and a jammed sheet can be easily removed. Access to the interior of the printer is improved by this arrangement.

DESCRIPTION OF THE ACCOMPANYING DRAWINGS

DESCRIPTION OF THE EMBODIMENTS

The embodiment of the thermal printer according to the present invention is detailed hereinafter, with reference to the accompanying drawings.

Figure 1:
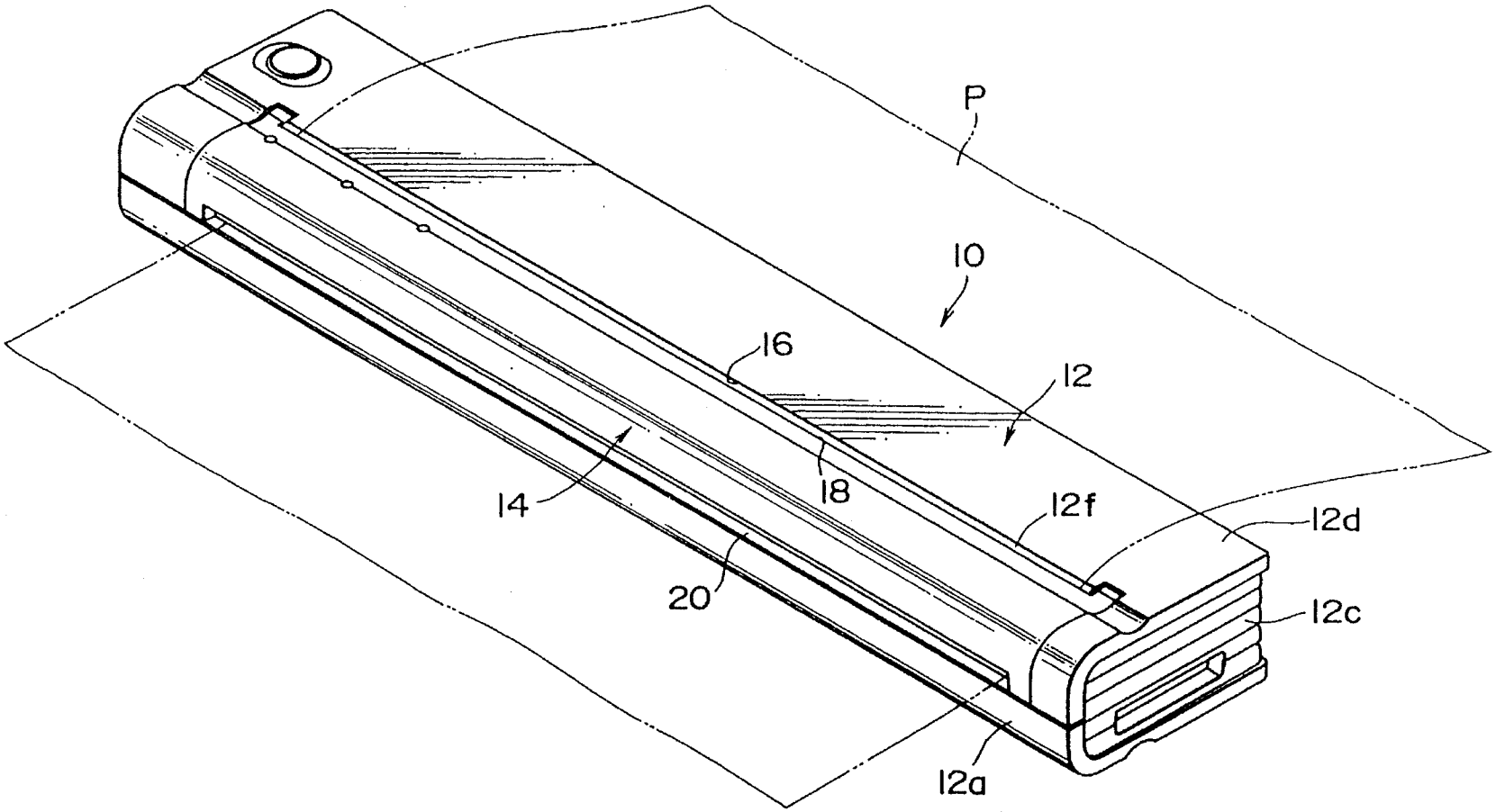
FIG. 1 is a perspective view of an embodiment of a thermal printer in accordance with the present invention, with the cover closed.
Figure 2:
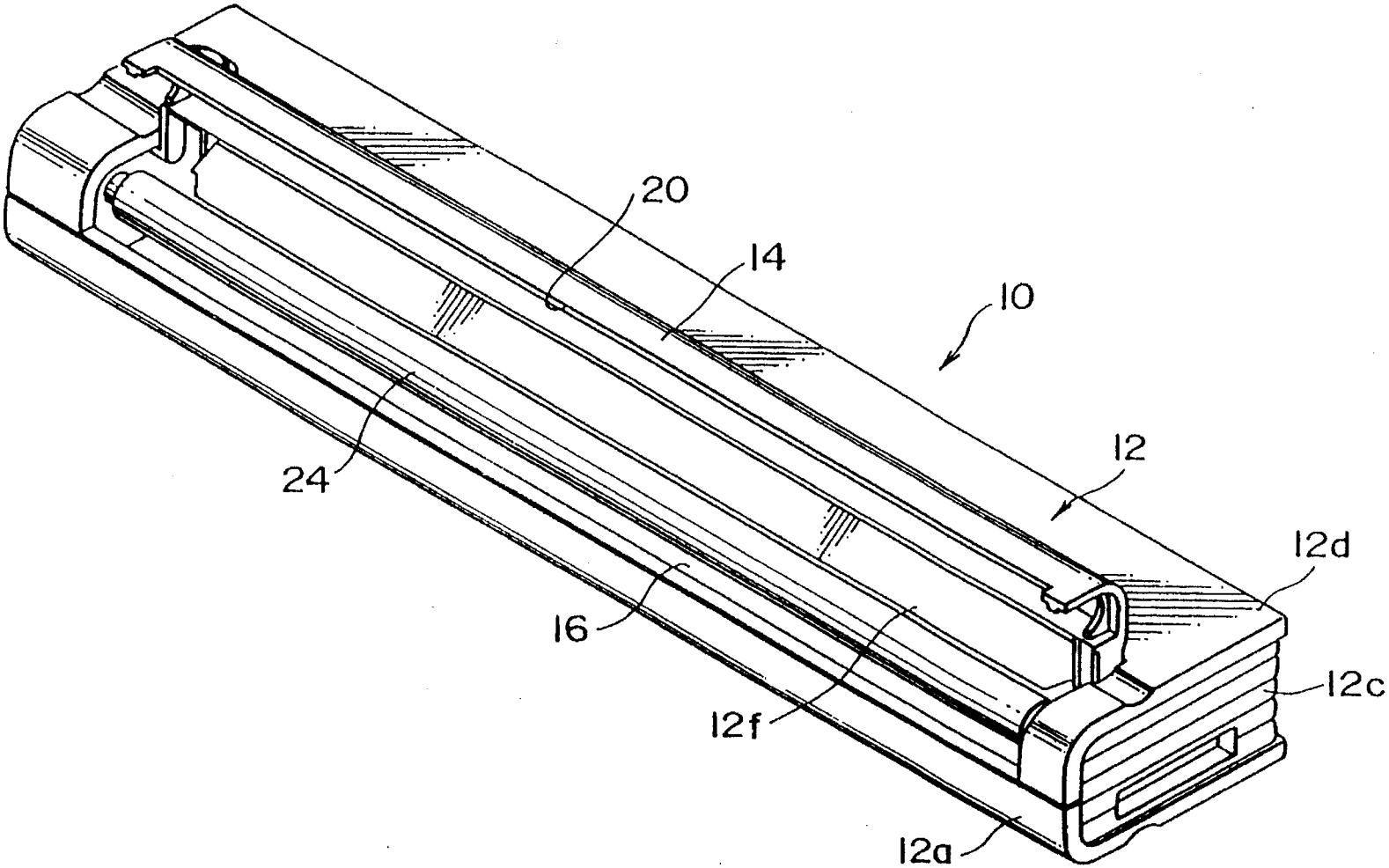
FIG. 2 is a perspective view of the thermal printer of FIG. 1, with the cover open.

As shown in FIGS. 1 and 2, a thermal printer 10 includes a housing 12 and a cover 14. The cover 14 allows access to the interior of the housing 12. The housing 12 includes an opening 16, formed between a top surface and a front side surface of an upper housing portion 12*d* of the housing 12. The cover 14 is fitted swingably in the opening 16 to open and close. The cover 14 has front and rear (with reference to FIG. 1) recesses formed therein. A paper insertion slot 18 is defined between the rear recess of the cover 14 and the top surface edge of the upper housing 12*d*. Similarly, a paper discharge slot 20 is defined between the front recess of the cover 16 and a side surface edge of a lower housing portion 12*a*.

The cover 14 is rotatably held by corner axes 14*b* (FIG. 3) near its rear corners, and is swingable between a closed position (shown in FIG. 1) and an open position (shown in FIG. 2). When closed, the cover 14 is substantially flat with reference to the top surface of the upper housing portion 12*d*, and forms the paper insertion and discharge slots 18 and 20, respectively.

Figure 3:
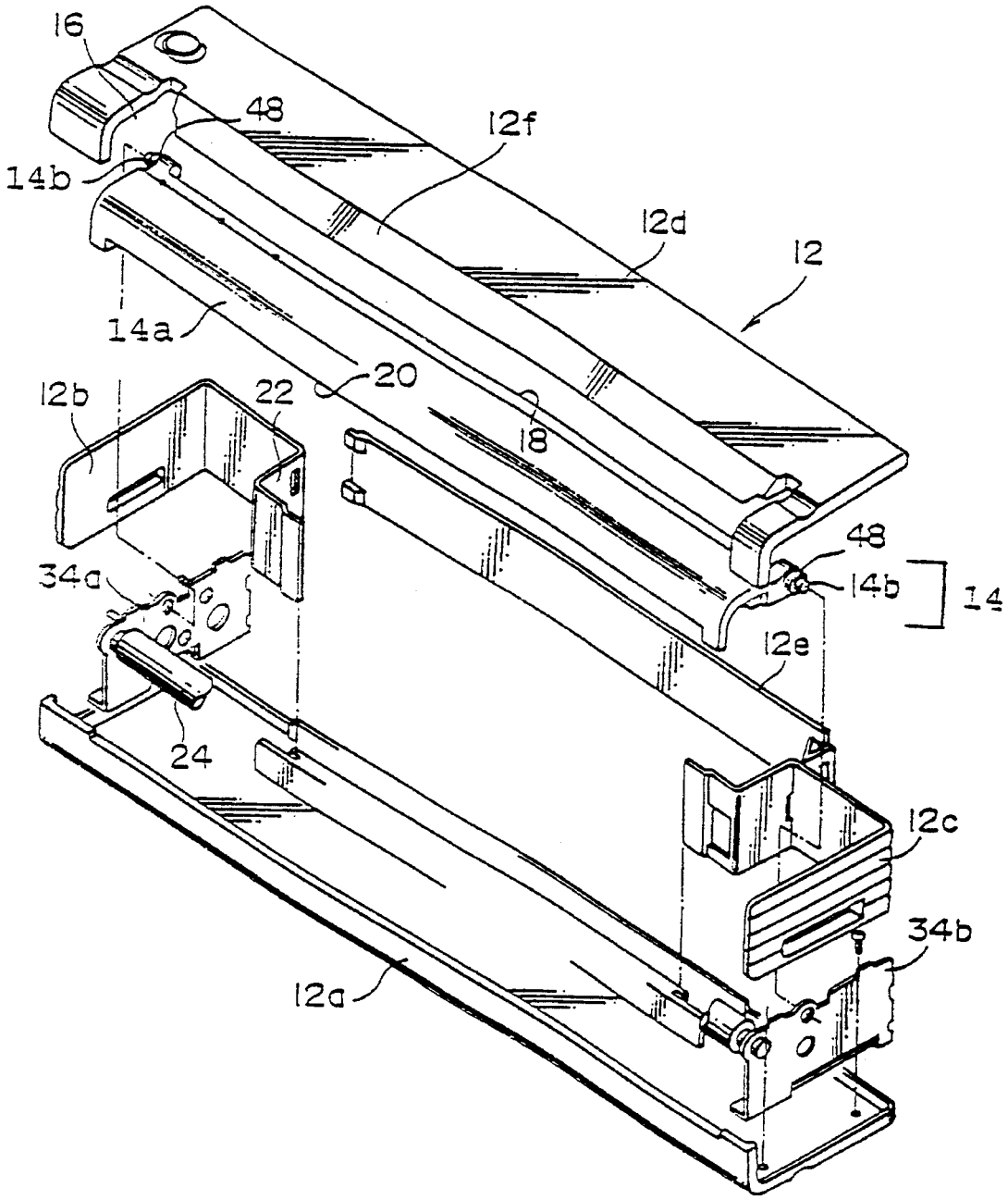
FIG. 3 is an exploded perspective view of the thermal printer of FIG. 1.

As shown in FIG. 3, the housing 12 includes: the lower housing 12*a;* left and right side covers 12*b* and 12*c*, respectively, provided on the sides of the lower housing 12*a;* the upper housing 12*d*, fixed on the side covers 12*b*, 12*c;* a battery chamber cover 12*e* at the rear of the housing 12, for covering a battery chamber 22 (shown in FIG. 6); and a guide plate 12*f*, formed at the front edge of the upper housing 12*d* and defining an upper boundary of the opening 16. All of the housing component parts 12*a* through 12*f* are preferably made of plastic materials.

The guide plate 12*f*, which guides paper to a line contact region between the rotatable platen roller 24 and the thermal line printhead, is integrally formed with the housing 12, extending downwards and forward from the top surface edge of the upper housing 12*d*. The side surface edge of the lower housing 12*a* extends across the width of the lower housing without breaks or steps, and defines both the lower boundary of the opening 16 and the lower boundary of the paper discharge slot 20. The side surface edge of the lower housing 12*a* at the paper discharge slot 20 are straight (no breaks or steps) in order to ensure the strength of the slot edge.

Figure 4:
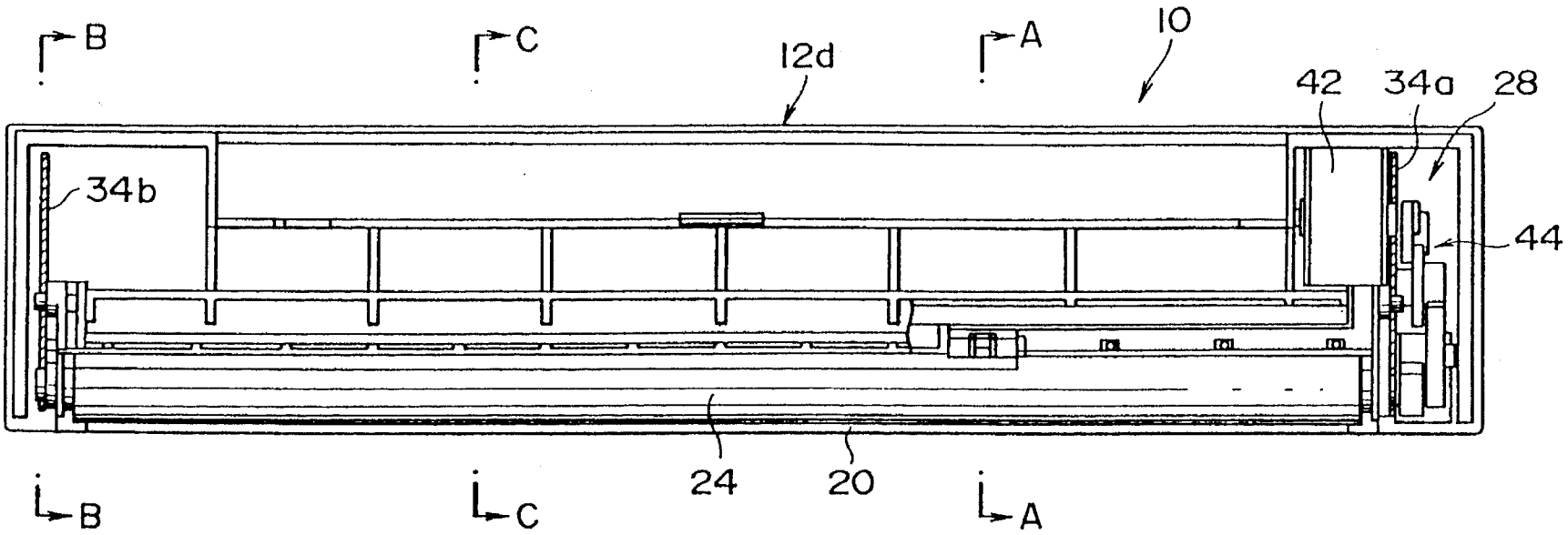
FIG. 4 is a bottom plan view of the thermal printer of FIG. 1, with a lower housing portion removed.
Figure 5:
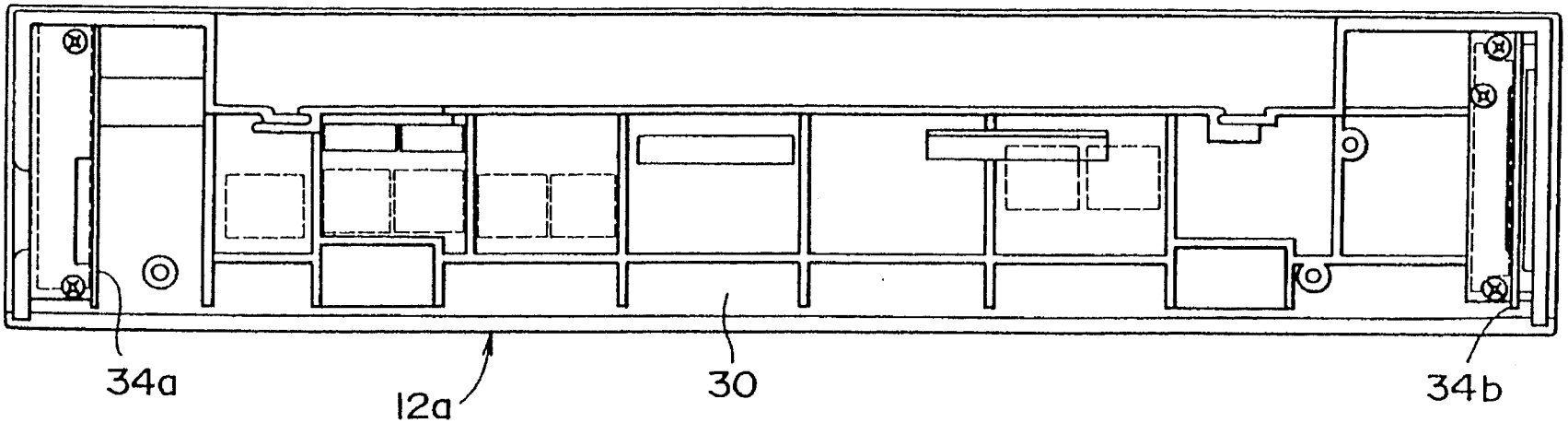
FIG. 5 is a top plan view of the lower housing portion of the thermal printer of FIG. 1.
Figure 6:
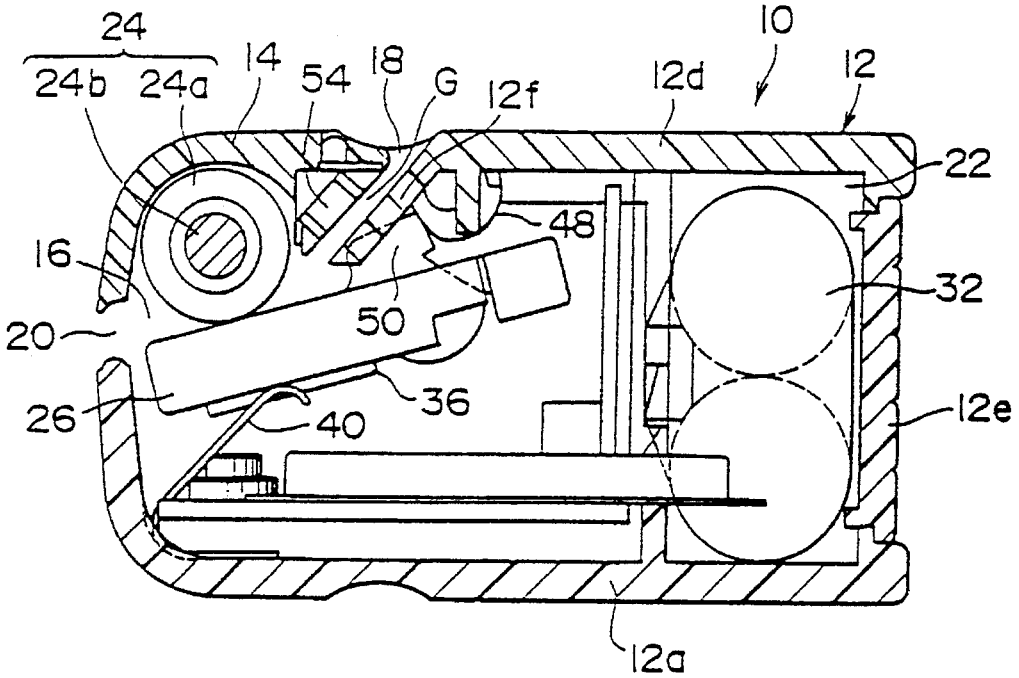
FIG. 6 is a sectional view of the thermal printer of FIG. 1, along the A—A sectional line shown in FIG. 4, showing the cover 14 closed.

FIGS. 4 to 9 detail the internal structural arrangement of the housing 12. As shown in FIG. 4, the major internal structural parts include: the rotatable platen roller 24 extending in the lateral direction of the paper; the thermal line printhead 26 (shown in FIGS. 6 to 9) contactable to, and swingable towards and away from, the platen roller 24; a driving mechanism 28 for the platen roller 24; a control circuit 30 (shown in FIG. 5) mounted on the bottom of the lower housing 12*a;* and a set of rechargeable batteries 32 (shown in FIG. 6) for supplying power to the printer, stored in the battery chamber 22. As shown in FIG. 6, the platen roller 24 further includes a roller portion 24*a*, having a predetermined elasticity; and axes 24*b* which protrude from both ends of the roller portion 24*a*. The control circuit 30 controls the heat emitting conditions of the thermal line printhead 26 and the driving movement of the driving mechanism 28, as determined by incoming printing image information from a data input port (not shown). In this embodiment, the rechargeable batteries 32 are nickel-cadmium batteries.

FIG. 4 shows a bottom view of the thermal printer 10, with the lower housing 12*a* removed. The driving mechanism 28 is mounted inside the right side mounting plate 34*a*. The driving mechanism 28 includes a driving motor 42, having an axis extending outward from the mounting plates 34*a*, and a gear train 44 mounted on the external face of the mounting plate 34*a*. The gear train 44 transmits the driving power of the driving motor 42 to rotate the platen roller 24 clockwise (from the perspective of FIG. 6).

Figure 7:
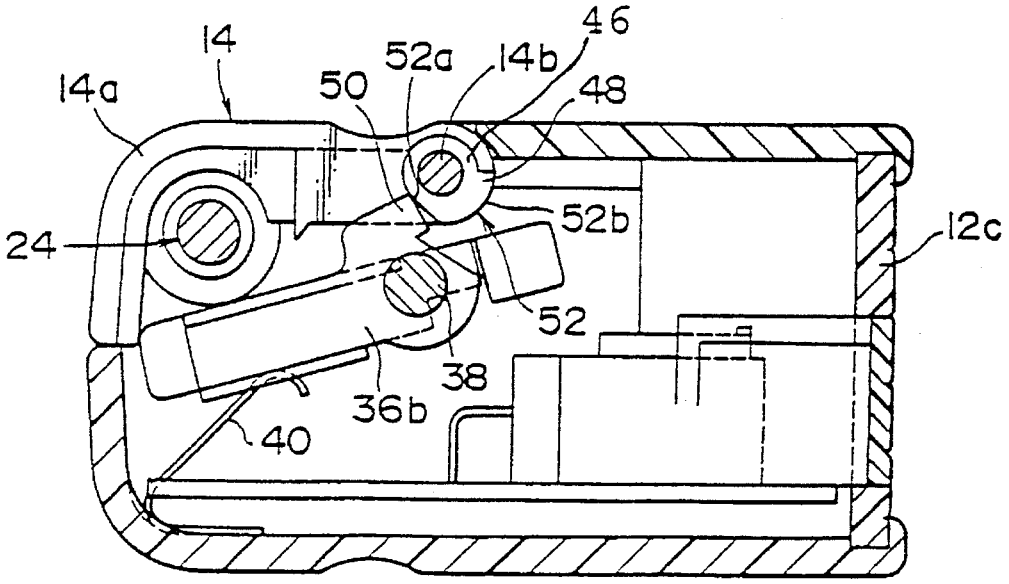
FIG. 7 is a sectional view of the thermal printer of FIG. 1, along the B—B sectional line shown in FIG. 4.
Figure 8:
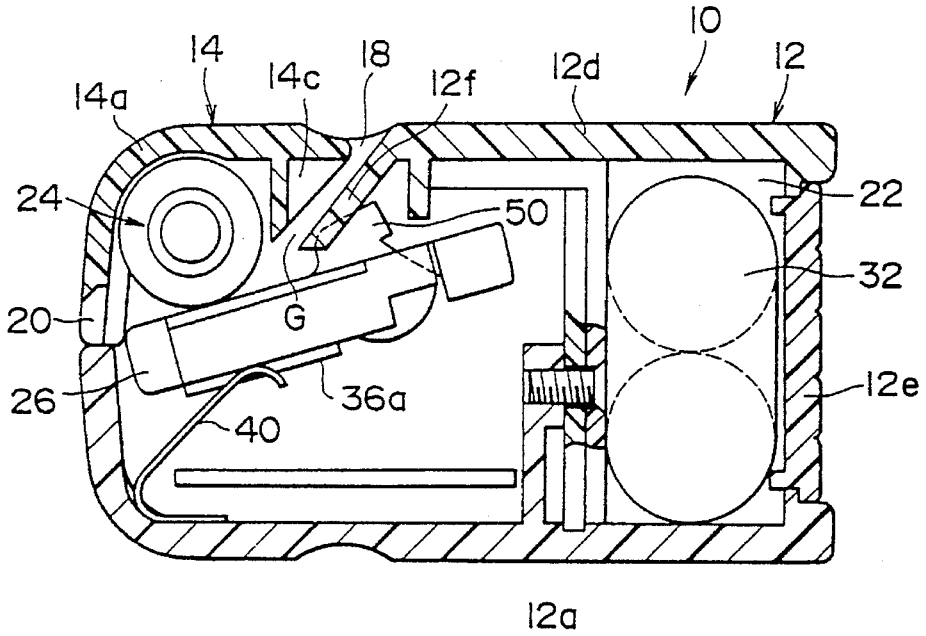
FIG. 8 is a sectional view of the thermal printer of FIG. 1, along the C—C sectional line shown in FIG. 4.

As shown in FIG. 7, the cover 14 includes a main body 14*a* and axes 14*b*. The axes 14*b* are integrally formed with the main body of the cover, and extend from both the left rear and right rear corners of the cover 14*a*. As shown in FIG. 8, a series of guide ribs 14*c* are formed on the cover 14 which face the guide plate 12*f* when the cover 14 is closed. The guide ribs 14*c* are formed a predetermined distance from the guide plate 12*f*, sufficient to allow insertion of paper through insertion slot 18. The guide ribs 14*c* and guide plate 12*f* form a guide transfer channel G to guide the thermosensitive paper to the contact line between the rotatable platen roller 24 and the thermal line printhead 26 from an upper oblique angle.

Upright metallic mounting plates 34*a* and 34*b* are fixed on both left and right ends of the lower housing 12*a*, as shown in FIGS. 4 and 5. The axes 14*b*, of the cover 14 are rotatably supported between the mounting plates 34*a* and 34*b*. The axis 24*b* of the platen roller 24 is also rotatably supported by the mounting plates 34*a* and 34*b*.

A pair of rotatable supporting frames 36*a* and 36*b* are provided to the ends of the thermal line printhead 26. Each of the frames 36*a* and 36*b* is provided with an axis 38 swingably supported by the mounting plates 34*a* and 34*b*. Thus, the thermal line printhead 26 is swingable by means of the swingable supporting frames 36*a* and 36*b*, and swingable with reference to the mounting plates 34*a* and 34*b*.

The mounting plates 34*a* and 34*b* each include a cam follower 50. The cam followers 50, 50 contact cams 48, 48 of a release mechanism 46 (described later). Furthermore, the thermal line printhead 26 is biased by a plate spring 40 (fixed on the bottom of the lower housing 12*a*) to swing toward, and contact with, the platen roller 24. The plate spring 40 also biases the thermal line printhead 26 such that the cam followers 50, 50 maintain contact with the corresponding cams 48, 48 of the release mechanism 46 when the cover 14 is open.

The release mechanism 46 guides the thermal line printhead 26 away from the platen roller 24 when the cover is opened (against the bias of the plate spring 40), and allows the thermal line printhead 26 to contact the platen roller 24 when the cover is closed (under the bias of the plate spring 40).

Figure 9:
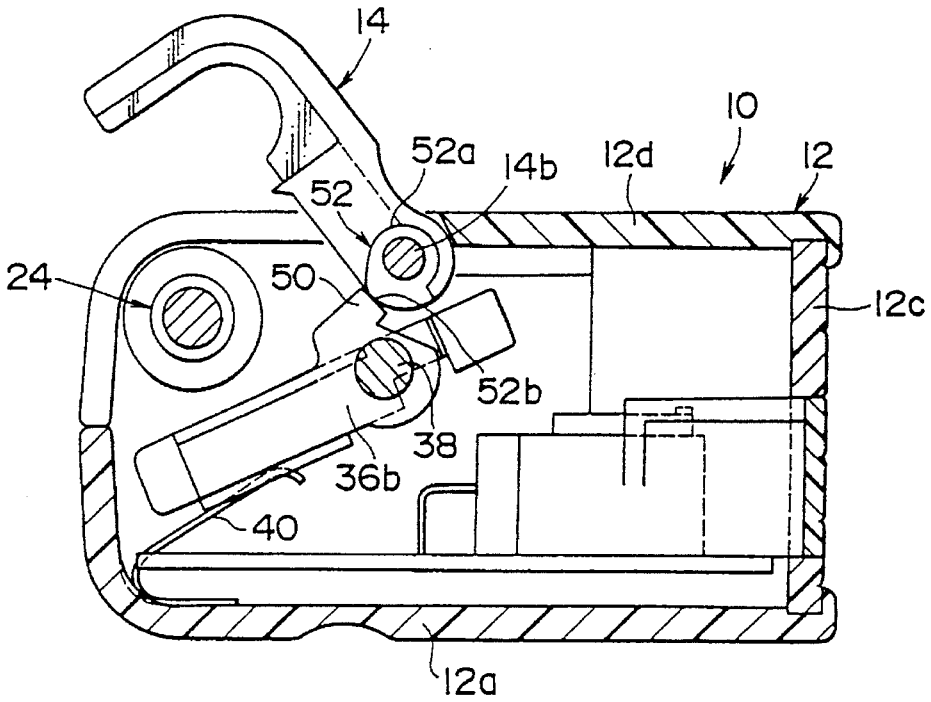
FIG. 9 is a sectional view of the thermal printer taken along line B—B of FIG. 4, with the cover open.

As shown in FIGS. 7 and 9, the release mechanism 46 includes the cams 48, 48, integrally formed at the bases of the axes 14*b* of the cover 14. Each cam 48 has a cam surface 52, and each cam surface 52 includes a first cam sector 52*a* and a second cam sector 52*b*. The cam surfaces 52, 52 are engageable with the cam followers 50, 50 of the supporting frames 36*a*, 36*b*. The second cam sectors 52*b*, 52*b* have increasing diameters to force the thermal line printhead 26 to separate from the platen roller 24 when the cover is opened (against the spring tension of the plate spring 40, and shown in FIG. 2). The first cam sectors 52*a*, 52*a* are of smaller diameter than the second cam sectors 52*b*, 52*b*, to allow the thermal line printhead 26 to return and contact the platen roller 24 under the spring tension of the plate spring 40 when the cover is closed (shown in FIG. 1).

Second cam sectors 52*b* are shaped such that when the cover 14 is swung beyond a predetermined amount, the radius of the cam 48 becomes constant within the cam sector 52*b*. In the constant radius portion of the second cam sector 52*b*, the returning force of the plate spring 40 does not transmit to the cover 14; as such, the cover 14 is held in the open position. However, in the remaining portion of the second cam sector 52*b*, the radius of the cam 48 is not constant. The returning force of the plate spring 40 transmits to the cover 14, urging the cover 14 to close. Thus, the cam 48 holds the cover 14 in the open position when the cover 14 swings beyond a predetermined amount, and also urges the cover 14 towards the closed position when the cover 14 swings less than the predetermined amount.

Furthermore, the thermal line printhead 26 is pressed against the platen roller 24 with a predetermined pressure (according to the plate spring 40) when the cover 14 is closed. The thermosensitive paper, held between the thermal line printhead 26 and the platen roller 24, is transferred toward the paper discharge slot 20 by the rotation of the platen roller 24 (driven by the driving mechanism 28). When the cover 14 is rotated open, the second cam sectors 52*b*, 52*b* of the cams 48, 48 engage the cam followers 50, 50, of the supporting frames 36*a* and 36*b*. The thermal printhead 26 is thereby guided to swing counterclockwise, against the spring tension of the plate spring 40, and away from the platen roller 24. As shown in FIG. 9, the thermal line printhead 26 separates from the platen roller 24, and a predetermined gap, depending on the radius of the second cam sectors 52*b* (in the constant radius portion) is formed therebetween.

The thermal line printhead 26 is rotatably supported by the metallic supporting frames 36*a* and 36*b*, and is directly driven by movement of cover 14 to separate from the platen roller 24. The thermal printer 10 arranged in this manner allows easy insertion of thermosensitive paper between the thermal line printhead 26 and the platen roller 24. If paper jams between the thermal line printhead 26 and the platen roller 24, the paper can be removed easily. Further, opening the cover 14 and forcing the thermal line printhead 26 to separate from the platen roller 24 places no significant mechanical load on the plastic housing 12, as both the thermal line printhead 26 and the platen roller 24 are rotatably supported by the rigid metallic mounting plates 34*a* and 34*b*. Still further, the mechanical strength of the lower housing 12*a* is not compromised by a large thermosensitive paper discharge slot 20, as the recess for the paper discharge slot 20 is formed entirely on the cover 14 (instead of the lower housing 12*a*). Therefore, the supporting frames 34*a* and 34*b* are mounted firmly on the lower housing 12, increasing the overall durability. These improved structural arrangements make the removal of a jammed paper through the large paper discharge slot 20 easier, and allow several functions to be shared among a few structural elements.

As shown in FIG. 6, a paper detecting sensor 54 is provided between the guide ribs of the guide 12*f*, and movable with the cover 14. The paper detecting sensor 54 faces a paper transfer channel G when the cover 14 is closed, and detects thermosensitive paper P. When the cover 14 is closed, the paper transfer channel G leads directly to the contact interface between the thermal line printhead 26 and the platen roller 24 and the paper detecting sensor 54 determines if the paper P is loaded. The paper detecting sensor 54 of the embodiment is a conventional photocoupler, and illuminates a paper P in the paper transfer channel G in a direction normal to the paper, transmitting a "paper loaded" signal when it receives light reflected back in the normal direction from the loaded thermosensitive paper P. When the sensor 54 does not receive light reflected back by the thermal printing paper P, it transmits a "no paper" signal.

Figure 11:
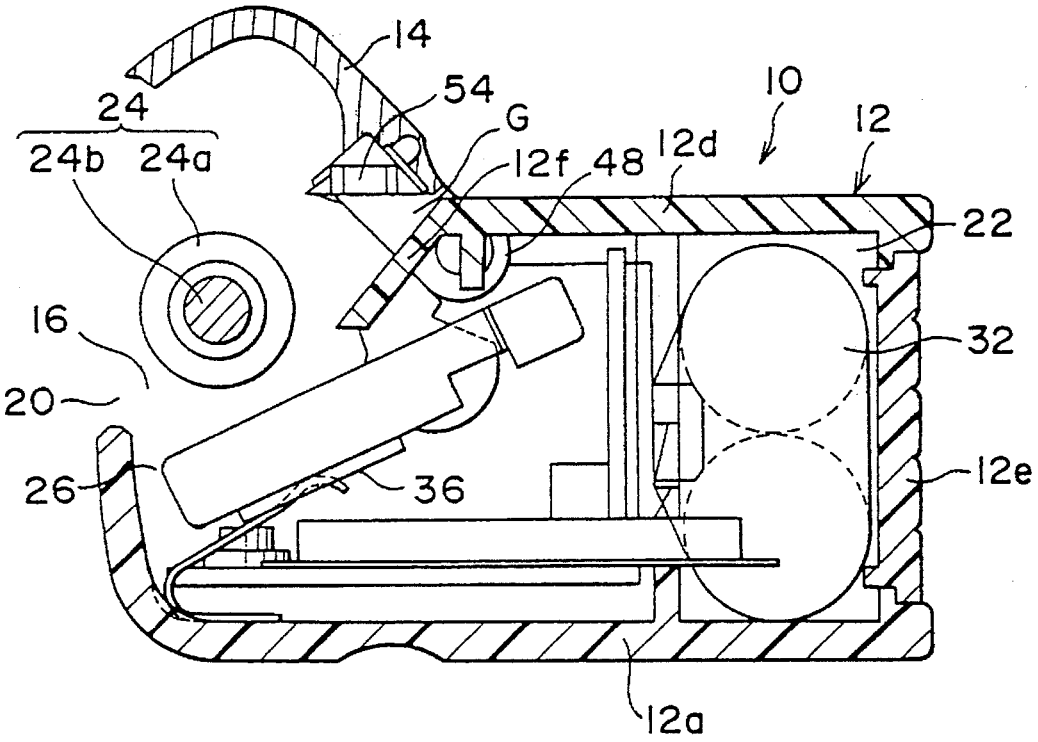
FIG. 11 is a sectional view of the thermal printer of FIG. 1, along the A—A sectional line shown in FIG. 4, showing the cover 14 in an open position.

The paper detecting sensor 54 is located on the cover 14 away from the axis of the cover 14, but facing the paper transfer channel G. As shown in FIG. 11, when the cover 14 is kept open, the paper detecting sensor 54 no longer faces the paper channel G, and the reflecting angle is improper for the sensor 54 to illuminate the paper P and receive reflected light. Thus, even if a sheet of thermosensitive paper is loaded in the paper transfer channel G, the sensor 54 does not detect the loaded paper and continues to emit a "no paper" signal.

Figure 10:
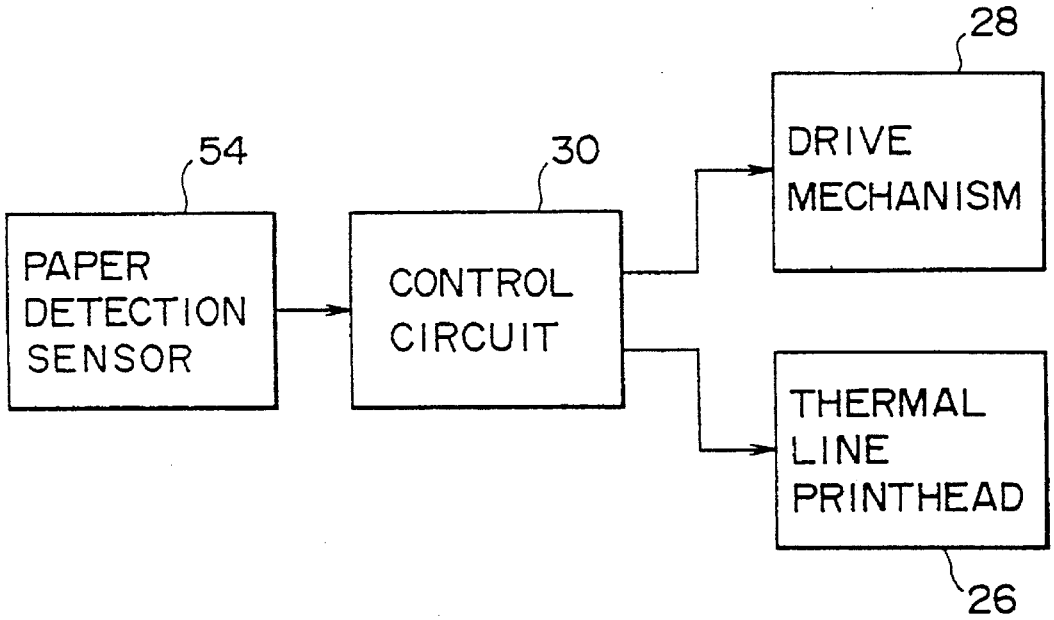
FIG. 10 is a block diagram representing a paper detection system of embodiment of a thermal printer according to the invention.

FIG. 10 shows a block diagram of a control circuit 30 connected to the paper detecting sensor 54. The control circuit 30 controls the printer 10 to print images only when it receives the "paper loaded" signal from the sensor 54, and prohibits and/or interrupts the printing of images when it receives the "no paper" signal.

Thus, the control circuit 30 controls the printer 10 to print images only when (i) the cover 14 is closed and (ii) the thermal printing paper P is loaded in the thermal paper transfer channel G. These two conditions are necessary for the sensor 54 to send the "paper loaded" signal to the control circuit 30. If the cover 14 is closed, but the thermal printing paper P is not loaded in the paper transfer channel G, the control circuit 30 receives the "no paper" signal from the sensor 54, and reacts accordingly by prohibiting or interrupting the printing of an image. If the cover 14 is open (as shown in FIG. 11), the control circuit 30 receives the "no paper" signal, regardless of the loading status of the thermal printing paper P in the paper transfer channel G, and prohibits or interrupts the printing operation.

According to this embodiment of the invention, the printer 10 does not distinguish between (A) a paper-not-loaded ("no paper") status, and (B) a status where the printer is incapable of printing because the platen roller 24 is separated from the thermal line printhead 26 by the opening of the cover 14. The printer 10 interprets both (A) and (B) operational states of the printer as the same status, and recognizes that printing should not be performed. Using the arrangement of the thermal printer 10 as embodied by the invention, one paper detecting sensor 54 can detect both (A) a paper-not-loaded or paper-out status, and (B) if the thermal line printhead 26 is separated from the platen 24. In either case, the printer 10 can prohibit or interrupt the printing of images, eliminating the need for two sensors, as is the case with conventional thermal printers. This simplified arrangement, as described, contributes to the miniaturization of the printer and to the reduction of manufacturing costs.

The present invention is not limited by the embodiment described above, and may be constructed with variations in structure without departing from the scope and spirit of the present invention.

The present disclosure relates to subject matter contained in Japanese Patent Application No. HEI 06- 128330, filed on May 18, 1994, which is expressly incorporated herein by reference in its entirety.

What is claimed is:

1. A thermal printer comprising:

a housing;

a cover member, rotatably mounted on said housing, and swingable between an open position and a closed position relative to said housing;

a platen roller rotatably supported in said printer;

a thermal line printhead swingably supported in said printer, said thermal line printhead being contactable to, and swingable towards and away from, said platen roller, and being adapted to form an image on said paper;

a transfer channel, defined between said cover member and said housing, for transferring paper between said platen roller and said thermal line printhead when said cover member is in said closed position;

said cover member being displaced from said paper when said cover member is in said open position;

means for moving said thermal line printhead out of contact with said platen roller, in response to movement of said cover member to said open position; and a paper detector, provided on said cover member, and being swingable with said cover member away from said paper to detect a presence or an absence of paper in said transfer channel when said cover member is in said closed position.

2. The thermal printer according to claim 1, wherein said paper detector is disposed on said cover member, said cover member having a swinging axis, said paper detector being spaced from said swinging axis of said cover member, such that said paper detector is disabled from detecting a presence of paper in said transfer channel when said cover member moves to said open position.

3. The thermal printer according to claim 2, further comprising:

means for interrupting and prohibiting printing, responsive to said paper detector detecting the absence of paper in said transfer channel.

4. The thermal printer according to claim 3, wherein said means for interrupting and prohibiting printing interrupts and prohibits printing when said cover member moves to said open position.

5. The thermal printer according to claim 4, further comprising:

means for enabling printing, responsive to said paper detector detecting the presence of paper in said transfer channel.

6. The thermal printer according to claim 5, further comprising a guide portion on said cover member that defines an upper boundary of said transfer channel; said housing including a guide wall that defines a lower boundary of said transfer channel, and said transfer channel leads directly to a contact interface between the said platen roller and said thermal line printhead.

7. The thermal printer according to claim 6, wherein said paper detector is disposed on said guide portion of said cover member.

8. The thermal printer according to claim 1, said paper detector further comprising:

a light emitter for emitting light towards said transfer channel; and a light receiver for receiving light reflected from said paper in said transfer channel, wherein said light emitter and light receiver emit and receive light in a direction normal to said paper in said transfer channel when said cover member is in said closed position.

9. The thermal printer according to claim 8, wherein said light emitter and light receiver are located on said cover member spaced from a swinging axis of said cover member, such that said light emitter and light receiver are disabled from emitting and receiving light in a direction normal to said paper in said transfer channel when said cover member moves from said closed position to said open position.

10. The thermal printer according to claim 1, further comprising:

said cover member having a first recess and a second recess formed therein, said first recess forming a paper insertion slot at an edge of said housing, and said second recess forming a paper discharge slot at a remaining edge of said housing, when said cover member is in said closed position.

11. The thermal printer according to claim 1, wherein said cover member further comprises means for holding said cover member in said open position when said cover member swings beyond a predetermined amount, and for returning said cover member to said closed position when said cover member swings less than said predetermined amount.

* * * * *